United States Patent [19]

Sandhaus

[11] Patent Number: 4,574,966

[45] Date of Patent: Mar. 11, 1986

[54] PLASTIC LINERLESS CLOSURE

[76] Inventor: Jeffrey Sandhaus, Rte. 9W, Sneden's Landing, Palisades, N.Y. 10964

[21] Appl. No.: 675,603

[22] Filed: Nov. 28, 1984

Related U.S. Application Data

[63] Continuation-in-part of Ser. No. 549,477, Nov. 7, 1983, Pat. No. 4,550,841, which is a continuation-in-part of Ser. No. 441,546, Nov. 15, 1982, Pat. No. 4,479,585, which is a continuation-in-part of Ser. No. 399,237, Jul. 19, 1982, Pat. No. 4,442,945, which is a continuation-in-part of Ser. No. 335,216, Dec. 28, 1981, Pat. No. 4,413,742.

[51] Int. Cl.[4] ..... B65D 53/00

[52] U.S. Cl. ..... 215/270; 215/344; 215/DIG. 1

[58] Field of Search ..... 215/329, 270, 341, 344, 215/DIG. 1

[56] References Cited

U.S. PATENT DOCUMENTS

| | | | |
|---|---|---|---|
| 3,069,040 | 12/1962 | Corsette | 215/344 X |
| 3,343,700 | 9/1967 | Heubl | 215/344 X |
| 3,494,496 | 2/1970 | Livingstone | 215/344 X |
| 3,568,871 | 3/1971 | Livingstone | 215/344 |
| 3,632,005 | 1/1972 | Kessler | 215/344 |

FOREIGN PATENT DOCUMENTS

| | | | |
|---|---|---|---|
| 1117478 | 2/1982 | Canada | 215/329 |
| 119788 | 9/1984 | European Pat. Off. | 215/329 |
| 2641543 | 3/1977 | Fed. Rep. of Germany | 215/270 |
| 607702 | 10/1978 | Switzerland | 215/344 |

*Primary Examiner*—Donald F. Norton

*Attorney, Agent, or Firm*—Kenyon and Kenyon

[57] ABSTRACT

A plastic linerless closure for sealing a container includes an integrated sealing mechanism forming at least a part of the top of the closure. The sealing mechanism includes a primary sealing region including a primary sealing flange adapted to engage the top of the container neck during application of the closure, an inner sealing region having an outwardly facing sealing surface which is situated contiguous with the inner surface of the container neck during application of the closure to the container neck and a central non-planar, e.g. concave, region. The inner sealing region is connected in an integrated manner to the primary sealing region and the central region, and the primary sealing flange is connected to the closure top by a hinge region. In operation, the primary and inner sealing regions as well as the non-planar central region of the integrated sealing mechanism act with mechanical linkage to effect a top seal between the primary sealing flange and the container neck top and an inner seal between the outwardly facing sealing surface of the inner sealing region and the container neck inner surface.

17 Claims, 4 Drawing Figures

PLASTIC LINERLESS CLOSURE

BACKGROUND OF THE INVENTION

This application is a continuation-in-part of application Ser. No. 549,477 filed Nov. 7, 1983 now U.S. Pat. No. 4,550,841; which is a continuation-in-part of application Ser. No. 441,546 filed Nov. 15, 1982, now U.S. Pat. No. 4,479,585, which is a continuation-in-part of application Ser. No. 399,237 filed July 19, 1982, now U.S. Pat. 4,442,945, which is a continuation-in-part of application Ser. No. 335,216 filed Dec. 28, 1981, now U.S. Pat. No. 4,413,742.

This invention relates generally to closures and, more particularly, to plastic linerless closures.

A great deal of effort has been directed to the design and development of a multi-application plastic linerless closure to replace conventional metal closures. Plastic linerless closures find use in such general areas as hermetic and vacuum applications in the food industry and in carbonated beverage applications. Other markets include pharmaceutical, cosmetics and dairy.

An important application of plastic linerless closures is the carbonated beverage industry. Attempts have been made to replace metal closures which are conventional in the carbonated beverage industry with a plastic linerless closure. In particular, the conventional aluminum roll-on carbonated beverage closures, such as disclosed in U.S. Pat. No. 3,601,273 to Kutcher, require expensive equipment to roll the aluminum shell onto the container threads and have become increasingly expensive due to the high cost of aluminum. Plastic closures are generally preferred over aluminum closures for other reasons. For example, plastic closures are considered safer than aluminum closures in that the possibility of the user being cut during handling the closure is eliminated. Plastic closures may be less likely to blow off from a carbonated beverage container and are able to withstand consumer mishandling to a much greater extent than are aluminum closures. Plastic closures are perceived by consumers as being cleaner than aluminum roll-on containers and on-torquing and off-torquing forces are less than the smaller diameter aluminum roll on closures. Indeed, surveys have indicated that consumers believe that beverages from a container sealed with a plastic closure taste better than in the case where the container is sealed by an aluminum closure. Significant savings can also be achieved utilizing plastic closures in that, for example, the thick glass and plastic neck finishes necessary for aluminum closures to withstand the high pressure during formation of the closure are not required for plastic closures. Container weight and container manufacturing cycle time can be reduced if these high pressures were not required.

Early plastic closures designed to replace conventional metal sealing closures usually incorporated a liner to compensate for the unevenness and ragged edges on the top lip or land of glass and plastic bottles. The pressure of application torque compresses the liner and its surface conforms to the contour of the top of the bottle to provide the seal. However, the development of plastic materials, such as polyethylene and polypropylene, has enabled linerless closures to be developed with integral sealing features which are often more effective than in the case of lined closures. Moreover, linerless closures are generally preferred in that they are more economical in manufacture.

Prior attempts to provide a suitable plastic linerless carbonated beverage closure have not been entirely successful. A plastic linerless closure must satisfy at least two criteria, namely low cost and good performance. The plastic closure must be cost competitive with the aluminum roll on closure. With respect to performance, the seal attained by the aluminum roll on closure is generally considered to be effective over an indefinite shelf life period if it has been properly applied. Removal torques are relatively constant over the full use temperature range. Aluminum is not affected by factors such as stress cracking from which previously suggested plastic linerless closures suffer. Plastic closures should be capable of being applied on a wide variety of capping lines and be designed to incorporate relatively simple yet effective tamper evident indicators.

Plastic linerless closures have been designed with a so-called land seal formed across the top of the neck finish or with a so-called valve seal formed on the inside or outside of the neck finish. Indeed, closures utilizing the combination of both types of seals have been suggested. A closure available from Sun Coast Plastic Closures, Inc. of Sarasota, Fla. includes two flexible wide angle sealing flanges which edge seal, independently of each other, with the inside and outside edges of the container neck. However, this closure has not been proven entirely satisfactory in that when applied to carbonated beverage containers, the pressure of the container contents tends to reduce the sealing force of the inner flange on the inside edge of the container neck. If this inner seal develops a leak, the container pressure will act on the outer flange and also thereby affect the overall reliability of the closure sealing. This closure is also subject to cracking due to stresses created in the region of the closure top between the inner and outer sealing flanges by vacuum, pressure or just the container to closure interface.

Other plastic linerless closures have been suggested. All of these prior closures utilize one or a combination of top or land and side or valve sealing flanges which act independently of each other. The seals provided by virtually all of such closures are the result of local deformations in the sealing flanges which occur when they are forced against the container neck. The reliability of these seals is adversely affected by the container pressure which acts in a manner which tends to reduce the sealing effectiveness, especially over extended periods of time due to cold flow or creep of the plastic. All plastics when loaded not only deform but continue to yield because of their viscoelastic nature. The sealing flanges utilized in conventional plastic linerless closures apply to carbonated beverage containers are continuously subjected to forces which tend to reduce their sealing effectiveness and over extended periods of time their sealing reliability is permanently reduced due to the cold flow or creep of the plastic material.

SUMMARY OF THE INVENTION

Accordingly, it is an object of the present invention to provide a new and improved plastic linerless closure for use in hermetic, vacuum and carbonated beverage applications.

Another object of the present invention is to provide a new and improved plastic linerless closure for carbonated beverage applications which is cost competitive with conventional aluminum roll on closures.

Still another object of the present invention is to provide a new and improved plastic linerless carbonated beverage closure which forms a seal which is competitive with the seal provided by conventional aluminum roll-on closures and which is significantly more reliable than seals provided by currently available plastic linerless closures.

A further object of the present invention is to provide a new and improved plastic linerless carbonated beverage closure which forms a seal with the container which is not adversely affected but, rather, is enhanced under the force of container pressure.

A still further object of the present invention is to provide a new and improved plastic linerless carbonated beverage closure which is not subject to stress cracking, which is capable of being applied on a wide variety of capping lines and is capable of incorporating relatively simple yet effective tamper evident indicators.

Briefly, in accordance with the present invention these and other objects are attained by providing a plastic linerless closure having an integrated sealing mechanism including a primary top or land sealing region, a secondary inner sealing region and a central region which are formed such that the sealing and central regions act in concert with each other in the form of a mechanical linkage during and after torquing of the closure onto the container to effect top and inner seals with the container neck. The flexural deformation of the primary top seal during engagement with the neck top is transmitted to the inner seal region in a manner to cause the inner seal to expand outwardly into tight sealing engagement with the inner surface of the container neck to thereby effect mutual primary top and inner seals.

The central region of the closure top forms a part of the integrated mechanical linkage along with the primary and inner sealing regions. The upward force exerted on the central region of the closure top by the contained pressure of carbonation is transmitted through a part of the secondary sealing region and a part of the primary sealing region in a manner which tends to rotationally flex the primary seal to enhance its sealing engagement with the neck top. The central region of the closure top preferably has a non-planar configuration such that the internal pressure (or vacuum) acting on it tends to flex or deform the top in a manner so as to expand the inner seal to enhance its sealing engagement with the inner surface of the neck. Moreover, the tendency of the central region of the closure and top to flex under the pressure (or vacuum) of the container contents to expand the inner seal is transmitted to the primary sealing region to further enhance its sealing engagement with the neck top.

A mechanism is thereby provided by which the inner sealing region is expanded radially outwardly during and after the application of the closure to the container to urge the inner sealing region tightly into sealing engagement with the inner surface of the container neck to provide a reliable seal. The mechanism is constituted by the primary sealing region which is situated between the closure skirt and the inner sealing region. The configuration of the primary sealing region is such that when the container neck acts upon it during application of the closure to the container, its flexural deformation (which effects the primary top seal) is transmitted to the inner sealing region to expand the latter tightly into engagement with the inner neck surface to effect the inner seal.

DETAILED DESCRIPTION OF THE DRAWINGS

A more complete appreciation of the present invention and many of the attendant advantages thereof will be readily understood by reference to the following detailed description when considered in connection with the accompanying drawings in which.

DESCRIPTION OF THE PREFERRED EMBODIMENTS

Figure 1:
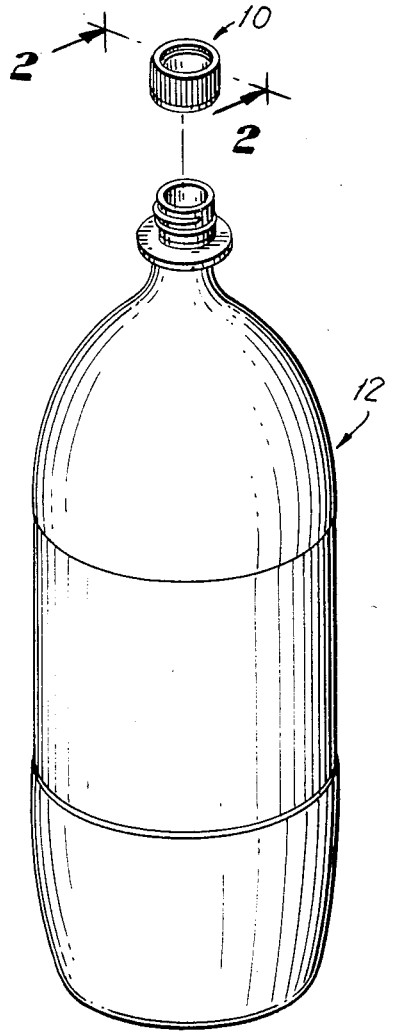
FIG. 1 is a perspective view illustrating a closure in accordance with the present invention in position for application to a conventional plastic carbonated beverage container.
Figure 2:
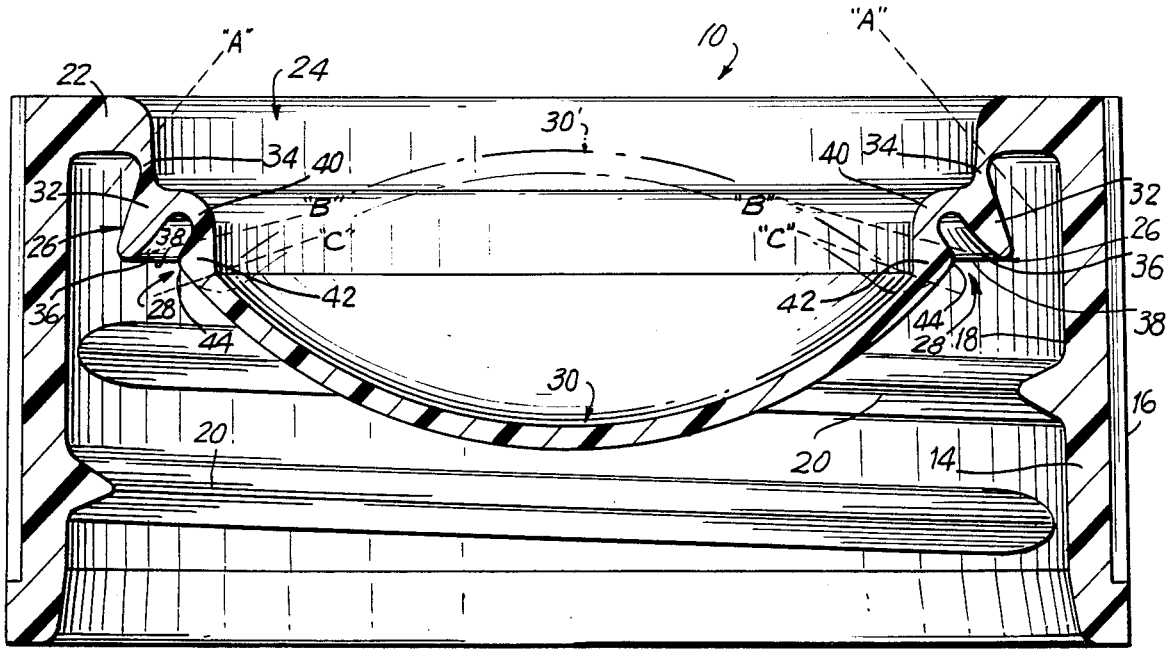
FIG. 2 is a section view taken along 2—2 of FIG. 1.

Referring now to the drawings wherein like reference characters designate identical or corresponding parts throughout the several views and, more particularly, to FIGS. 1 and 2, a plastic linerless closure in accordance with the present invention is generally designated 10. The closure 10 as illustrated herein is a 28 mm closure adapted for closing and sealing a conventional two liter plastic (PET) carbonated beverage container 12. However, it will be understood that closures in accordance with the invention can be used on other sizes of conventional plastic and glass containers and in other applications such as hermetic, neutral, vacuum and other pressurized container applications including food, dairy, pharmaceutical and cosmetic, among others. Closure 10 is constructed in a one-piece unitary manner of any suitable plastic material, such as polyethylene or polypropylene, by any suitable plastic forming technique, such as injection molding, as will be readily understood by those skilled in the art.

Closure 10 includes an outer skirt 14 having a fluted outer surface 16 and an inner surface 18 on which internal threads 20 are formed. Skirt 14 terminates at its upper end at a top shoulder 22 which extends inwardly from skirt 14 and integrally joins the integrated sealing mechanism 24 of the closure at its outer periphery which is the circular portion of the closure intersected by the imaginary conical section designated "A". The top shoulder 22 and integrated sealing mechanism 24 together constitute the top of closure 10.

The sealing mechanism 24 includes a primary sealing region 26 extending between section "A" and a circular portion of the closure intersected by the imaginary conical section "B", the secondary sealing region 28 extending between section "B" and a circular portion of the closure intersected by the imaginary conical section "C", and the concave central region 30 bounded on its periphery by the section "C".

The primary sealing region 26 includes a circular sealing flange 32 which is connected along its length to the top shoulder 22 by a web-like, thinned hinge region 34. Primary sealing flange 32 generally extends downwardly and outwardly terminating at its lower inner end at a circularly extending sealing surface 36 which slopes upwardly and inwardly a limited distance from the lowermost region 38 of sealing flange 32. It is noted that the lowermost region 38 of flange 32 and the lower region of its sealing surface 36 are situated outwardly of hinge region 34.

In addition to the primary sealing flange 32, the primary sealing region includes a connecting portion 40 having a curved cross-section, the upper part of which joins the primary sealing flange 32 at the upper area of its inner surface. The connecting portion 40 thus extends inwardly from the top of primary sealing flange 32 and then curves downwardly towards the secondary sealing region 28.

The secondary sealing region 28 is constituted by an enlarged bead-like inner sealing portion 42 having an outwardly facing sealing surface 44. Inner sealing portion 42 essentially forms a lower continuation of connecting portion 40 and an upper continuation of concave central region 30.

Figure 3:
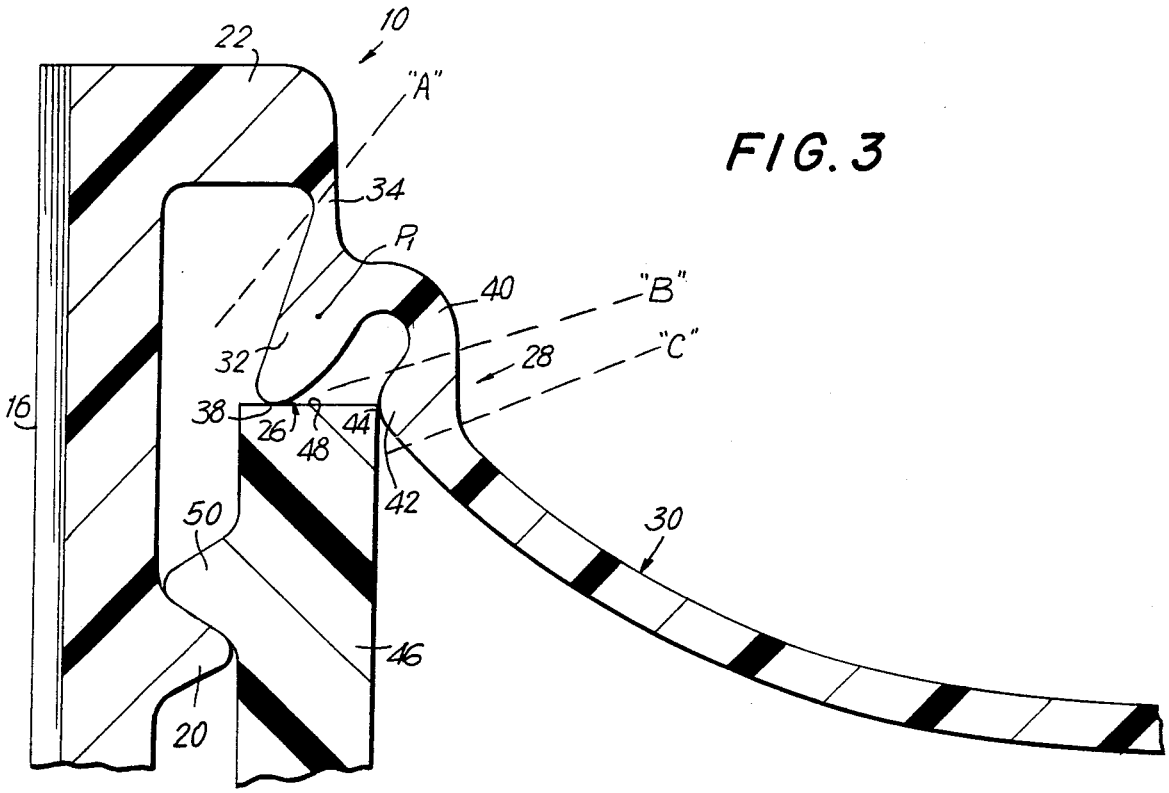
FIG. 3 is a detailed section view of the closure illustrated in FIG. 1 shown after application to the container neck but prior to initial seal-effecting torquing of the closure.

In its normal configuration, i.e., prior to the application of the closure 10 to container 12 to form a seal (FIGS. 2 and 3), the diameter of the circular lowermost region 38 of flange 32 is in the range between the inner and outer diameter of the neck 46 of container 12 so that as the closure 10 is torqued onto the container neck, the lowermost primary flange region 38 initially engages the top or land 48 of neck 46. Most preferably, the primary flange 32 engages a region of the neck top 48 which is closer to the outer edge than the inner edge as seen in FIG. 3. The diameter of the circular outwardly facing sealing surface 44 of inner sealing portion 42 is substantially equal to the diameter of the inner surface of container neck 46 so that as the closure 10 is torqued onto the container neck, the sealing surface 44 of sealing portion 42 engages the inner surface of neck 46 with a tight slip fit.

In the case of a 28 mm closure, the diameter of the lowermost region 38 of flange 32 may be about 0.967 inches and the diameter of the outwardly facing sealing surface 44 of inner sealing portion 42 is about 0.856 inches.

The operation of the integrated sealing mechanism 24 as closure 10 is applied to container neck 46 will now be described. As closure 10 is torqued down, the sealing surface 44 of inner sealing portion 42 makes initial engagement with the inner surface of container neck 46. As noted above, this engagement is not necessarily a sealing engagement but is preferably a tight slip fit. At substantially the same time or immediately thereafter, with continued torquing of closure 10, the lowermost region 38 of flange 32 engages the top or land 48 of container neck 46. This condition is illustrated in FIG. 3.

Figure 4:
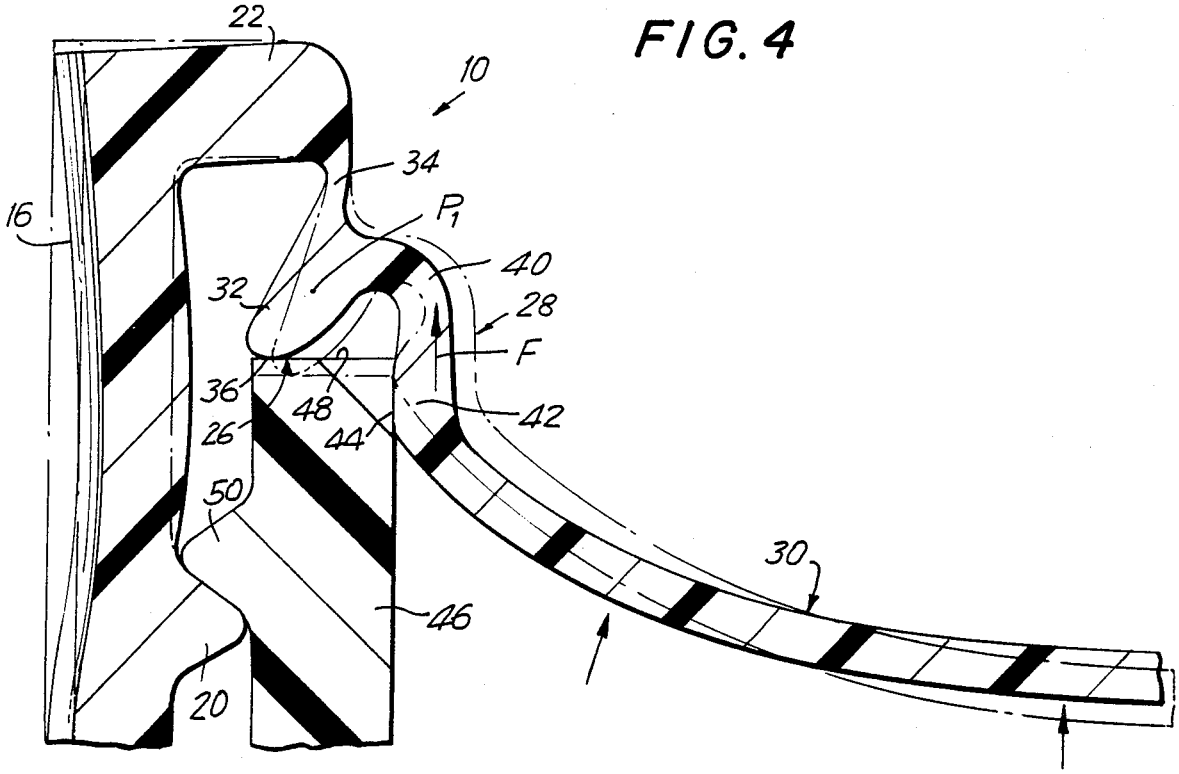
FIG. 4 is a view similar to FIG. 3 shown after the closure has been fully torqued onto the container neck.

As the torquing of closure 10 is continued to completion, the primary sealing flange 36 is forced against the neck land 48. Referring to FIG. 4, this results in a tendency for the entire primary sealing region 26 to flex about a circular line $P_1$ which is situated approximately at the center of mass of the primary sealing region 26 from its original position shown in phantom in FIG. 4 to the solid line position. This tendency for the primary sealing region to flex in turn results in flexure of the primary sealing flange 32 about the hinge region 34 so that the primary sealing region 26 tightly and sealingly engages the top 48 of container neck 46. At the same time the tendency for the primary sealing region 26 to flex about line $P_1$ results in the expansion of the inner sealing portion 42 so that the inner sealing surface 44 tightly sealingly engages the inner surface of container neck 46. The expansion of the inner sealing portion 42 is accommodated by the non-planar configuration of the central region 30 of the integrated sealing mechanism 24 which, although being concave in the illustrated preferred embodiment, could be convex and still permit expansion of the inner sealing portion 42. Indeed, the central region 30 is preferably convex as shown at 30'(FIG. 2) when the container contents are saled under a vacuum. The concave central portion 30 flexes at least slightly from its original position shown in phantom in FIG. 4 to the solid line position thereby accommodating the expansion of inner sealing portion 42. The amount of flexure of the central region is shown somewhat exaggerated in FIG. 4 for purposes of clarity. Thus, in the manner described above mutual primary top or land and inner seals are effected.

At the same time, the carbonation pressure within container 12 advantageously enhances both the primary and inner seals by two separate and distinct effects. Firstly, the internal contained pressure exerts a force on the closure which tends to lift it from the closure and which is resisted by the cooperating threads. The lifting force is transmitted through the upstanding region of the connecting portion 40 as shown by the arrow F in FIG. 4. The lifting force F also tends to rotate the primary sealing flange about hinge region 34 to thereby enhance the primary top or land seal. This action again is a result of the position of hinge region 34 inwardly of the area of the neck top engaged by primary sealing region 26. It is noted that this action does not necessarily rely on the central region 30 having a concave or even non-planar configuration.

Secondly, the inner seal is enhanced by the carbonation pressure by virtue of the concave configuration of central region 30. In particular, the container pressure also tends to flatten the central region 30 which in turn tends to expand the inner sealing portion 42 into tighter sealing engagement with the inner surface of container neck 46. Moreover, the integrated nature of the primary and secondary sealing regions results in this expansion of the inner sealing portion being in turn transmitted to the primary sealing region to further enhance the primary seal.

The top shoulder 22 is relatively thick and acts as a reinforcing shoulder to prevent movement of the primary sealing region away from the container neck over extended periods of time. It is also seen that when sealing is effected through the flexure of the integrated sealing mechanism, the upper portion of the closure skirt 14 is bowed inwardly to some extent. Such bowing can be eliminated if desired by appropriately thickening the upper portion of the closure skirt. This inward bowing increases the locking engagement of the upper closure threads 50 with the upper container threads 20.

It is seen from the foregoing that the primary and inner sealing regions 26 and 28 act in concert with each other and with the concave central region 30 in an integrated manner in the form of a mechanical linkage during and after torquing of the closure onto the container in order to effect mutual top and inner seals. The flexure of the primary sealing flange 32 during engagement with the top 48 of the container neck is transmitted to the inner sealing portion 42 to cause the latter to expand into tight sealing engagement with the inner surface of the container neck. The central region 30 of the closure top forms a part of the integrated sealing mechanism 24 along with the primary and secondary sealing regions 26 and 28 in a manner such that the upward force exerted on the central region is transmitted through the mechanism to enhance both the primary and secondary seals. This is directly contrary to all conventional plastic linerless closures where the pressurized container contents tends to undermine the reliability of the seals. The sealing obtained in conventional plastic linerless closures is the result of only local deformations and any sealing engagement made at the top, inner or outer edges of the container neck are independent of each other.

Although the closure 10 is described above with specific application to carbonated beverage containers, a closure in accordance with the invention can be used in hermetic and vacuum applications as well. As noted above, when used in vacuum applications, the central region 30 preferably has a convex configuration, designated 30' in FIG. 2. The central region 30' will be acted upon by a downward force due to the pressure differential and tend to expand the inner sealing portion to enhance the inner and, in turn, the primary seal. The closure can be easily molded in a economic manner from standard plastic materials. The sealing achieved by the closure in carbonated beverage applications is at least as effective as that provided by aluminum roll-on closures and is substantially more reliable than seals provided by currently available plastic linerless closures, especially in view of the fact that the internal container pressure facilitates the sealing rather than undermines the same. The closure is not subject to stress cracking since there are no regions of stress concentration created during torquing of the closure onto the container. The closure may be provided with any conventional tamper evident features such as a mechanical band which may be left on the container or removed with the closure. Alternatively, a tamper evident feature of the type disclosed in U.S. Pat. No. 4,479,585 to Sandhaus may be incorporated. For example, a brittle lacquer coating may be provided on the outer surface of the central region 30. Flexure of the central region 30 upon initial removal of the closure from the container will cause the coating to fracture indicating that the closure has been removed at some previous time.

A closure in accordance with the present invention is also especially suited for sealing retorted foodstuffs, i.e., foods cooked in their container after the closure has been applied. In such applications, the concave central portion 30 will become less concave, and possibly convex, during the cooking operation and will tend to return to a more concave shape upon cooling. The central portion, however, will not quite return to as concave a configuration as it had prior to the cooking operation so that a more effective sealing is obtained after retorting.

Advantageously, the concave central portion of the closure forms a "well" which can be utilized for any suitable purpose. For example, the closure may be provided with an integrally molded or separately applied member to cover the well so as to form a compartment for food additives or other products. The well may be used as a measurement tool or to exhibit promotional material.

Obviously, numerous modifications and variations of the present invention are possible in the light of the above teachings. It is therefore to be understood that within the scope of the claims appended hereto, the invention may be practiced otherwise than as specifically disclosed herein.

What is claimed is:

1. A closure for application to a neck of a container, said neck having a top, inner and outer surfaces, comprising:

a skirt; and, a top, coupled to said skirt, including:

a displaceable sealing member adapted to engage said top surface of said neck with application of said closure to said neck;

an inner sealing region having an outwardly facing sealing surface adapted to be situated contiguous with said inner surface of said container neck with application of said closure to said container neck; and, means, coupled to said sealing member and said inner sealing region, for urging said outwardly facing sealing surface outwardly against said inner surface of said container neck in response to displacement of said sealing member through engagement thereof with said top surface of said neck.

2. A closure as in claim 1 wherein said sealing member comprises a flange extending downwardly and outwardly and having a sealing surface extending upwardly and inwardly from a lowermost region of said flange, and wherein said urging means comprises a movable connecting portion extending inwardly from an upper area of said flange sealing surface, and extending downwardly to an upper area of said inner sealing region, said inner sealing region being pulled outwardly against said inner surface of said neck by said connecting portion in response to outward displacement of said flange through engagement thereof with said top surface of said neck.

3. A closure as in claim 1 wherein said top further includes a central region coupled to said inner sealing region, said central region accommodating said urging outwardly of said inner sealing region.

4. A closure as in claim 3 wherein said top includes means, coupled to said skirt, for enhancing engagement of said sealing member with said top surface of said neck in response to lifting of said inner sealing region relative to said skirt.

5. A closure as in claim 4 wherein said sealing member comprises a flange extending downwardly and outwardly and having a sealing surface extending upwardly and inwardly from a lowermost region of said flange, and wherein said urging means comprises a movable connecting portion extending inwardly from an upper area of said flange sealing surface, and extending downwardly to an upper area of said inner sealing region, said inner sealing region being pulled outwardly against said inner surface of said neck by said connecting portion in response to outward displacement of said flange through engagement thereof with said top surface of said neck.

6. A closure as in claim 5 wherein said enhancing means comprises:

said connecting portion;

a shoulder, coupled to an upper region of said skirt, extending inwardly from said skirt; and, a hinge, coupled between a lower area of said shoulder and an upper area of said flange, said hinge being disposed inwardly of said lowermost region of said flange, lifting of said inner sealing region causing lifting of said connecting portion, engendering downward rotation of said flange about said hinge, for enhancing engagement of said flange with said top surface of said neck.

7. A closure as in claim 4 wherein said enhancing means comprises:

a connecting portion, coupled between said sealing member and said inner sealing region;

a shoulder, coupled to an upper region of said skirt, extending inwardly from said skirt; and, a hinge, coupled between a lower area of said shoulder and an upper area of said sealing member, lifting of said inner sealing region causing lifting of said connecting portion, engendering downward rotation of said sealing member about said hinge, for enhancing engagement of said sealing member with said top surface of said neck.

8. A closure as in claim 4 wherein said central region comprises a concave configuration, said concave configuration deforming with application of pressure to a lower surface thereof causing outward expansion of said inner sealing region.

9. A closure as in claim 8 wherein said sealing member comprises a flange extending downwardly and outwardly and having a sealing surface extending upwardly and inwardly from a lowermost region of said flange, and wherein said urging means comprises a movable connecting portion extending inwardly from an upper area of said flange sealing surface, and extending downwardly to an upper area of said inner sealing region, said inner sealing region being pulled outwardly against said inner surface of said neck by said connecting portion in response to outward displacement of said flange through engagement thereof with said top surface of said neck.

10. A closure as in claim 9 wherein said enhancing means comprises:

said connecting portion;

a shoulder, coupled to an upper region of said skirt, extending inwardly from said skirt; and, a hinge, coupled between a lower area of said shoulder and an upper area of said flange, said hinge being disposed inwardly of said lowermost region of said flange, lifting of said inner sealing region causing lifting of said connecting portion, engendering downward rotation of said flange about said hinge, for enhancing engagement of said flange with said top surface of said neck.

11. A closure as in claim 3 wherein said central region comprises a convex configuration, said convex configuration deforming in response to greater pressure on an upper surface thereof than on a lower surface thereof, causing outward expansion of said inner sealing region.

12. A closure as in claim 11 wherein said sealing member comprises a flange extending downwardly and outwardly and having a sealing surface extending upwardly and inwardly from a lowermost region of said flange, and wherein said urging means comprises a movable connecting portion extending inwardly from an upper area of said flange sealing surface, and extending downwardly to an upper area of said inner sealing region, said inner sealing region being pulled outwardly against said inner surface of said neck by said connecting portion in response to outward displacement of said flange through engagement thereof with said top surface of said neck.

13. A closure as in claim 12 further comprising:

a shoulder, coupled to an upper region of said skirt, extending inwardly from said skirt; and, a hinge, coupled between a lower area of said shoulder and an upper area of said flange, said hinge being disposed inwardly of said lowermost region of said flange.

14. A closure for application to a neck of a container, said neck having a top, inner and outer surfaces, comprising:

a skirt; and, a top, coupled to said skirt, including: a sealing member adapted to engage said top surface of said neck with application of said closure to said neck;

an inner sealing region having an outwardly facing sealing surface adapted to be situated contiguous with said inner surface of said container neck with application of said closure to said container neck;

a central region coupled to said inner sealing region; and, means, coupled to said skirt, for enhancing engagement of said sealing member with said top surface of said neck in response to lifting of said inner sealing region relative to said skirt.

15. A closure as in claim 14 wherein said sealing member comprises a flange extending downwardly and outwardly and having a sealing surface extending upwardly and inwardly from a lowermost region of said flange; and, wherein said enhancing means comprises:

a connecting portion extending inwardly from an upper area of said flange sealing surface, and extending downwardly to an upper area of said inner sealing region;

a shoulder, coupled to an upper region of said skirt, extending inwardly from said skirt; and, a hinge, coupled between a lower area of said shoulder and an upper area of said flange, said hinge being disposed inwardly of said lowermost region of said flange, lifting of said inner sealing region causing lifting of said connecting portion, engendering downward rotation of said flange about said hinge, for enhancing engagement of said flange with said top surface of said neck.

16. A closure as in claim 15 further comprising means, coupled to said sealing member and said inner sealing region, for urging said outwardly facing sealing surface outwardly against said inner surface of said container neck in response to displacement of said sealing member through engagement thereof with said top surface of said neck.

17. A closure as in claim 15 wherein said central region comprises a concave configuration, said concave configuration deforming with application of pressure to a lower surface thereof causing outward expansion of said inner sealing region.

* * * * *